US005769686A

United States Patent [19]

Duncan et al.

[11] Patent Number: 5,769,686

[45] Date of Patent: Jun. 23, 1998

[54] YO-YO HAVING AN IMPROVED AXLE AND INSERT RETAINER

[75] Inventors: Donald F. Duncan, Tucson; Thomas J. Van Dan Elzen, Oro Valley, both of Ariz.

[73] Assignee: Playmaxx, Inc., Tucson, Ariz.

[21] Appl. No.: 681,835

[22] Filed: Jul. 29, 1996

Related U.S. Application Data

[60] Provisional application No. 60/003,792 Sep. 15, 1995.

[51] Int. Cl.[6] ..... A63H 1/30

[52] U.S. Cl. ..... 446/250

[58] Field of Search ..... 446/247, 248, 446/250, 251

[56] References Cited

U.S. PATENT DOCUMENTS

| | | | |
|---|---|---|---|
| 2,629,202 | 2/1953 | Stivers et al. | 446/250 |
| 3,256,635 | 6/1966 | Radovan | 446/251 |
| 3,444,644 | 5/1969 | Sayegh | 446/250 |
| 3,805,443 | 4/1974 | Duncan, Jr. | 446/250 |
| 4,895,547 | 1/1990 | Amaral | 446/250 |
| 5,017,172 | 5/1991 | Seifert | 446/250 |
| 5,100,361 | 3/1992 | Kuhn et al. | 446/250 |

*Primary Examiner*—William H. Grieb
*Attorney, Agent, or Firm*—Franklin Gubernick

[57] ABSTRACT

A yo-yo having a unique axle design and end pieces capable of retaining POG-shaped inserts. The axle is designed to increase the yo-yo's sleep time as well as to improve the facility with which the yo-yo can be returned from a sleeping condition. The yo-yo's axle includes an axle block that is itself similar in shape to a yo-yo and has a uniquely shaped central groove. The groove has parallel upper sidewalls and a bottom tapered section. The axle block is preferably made of wood and the yo-yo's end members are preferably made of plastic. When a wooden axle block is used with plastic end members, the yo-yo will display the performance advantages that were previously only afforded by wooden yo-yo's while at the same time providing the lower manufacturing costs and high durability of a plastic yo-yo. The yo-yo's end pieces include retaining structure that allows a user to secure a POG-shaped insert to each end piece. The end pieces may include two retaining structures to enable a user to secure two inserts to each end piece with the outer insert overlying and thereby protecting the inner insert.

21 Claims, 2 Drawing Sheets

YO-YO HAVING AN IMPROVED AXLE AND INSERT RETAINER

This application claims the benefit of U.S. Provisional application Ser. No. 60/003,792, filed Sep. 15, 1995.

FIELD OF THE INVENTION

The invention is in the field of user-manipulated toys. More particularly, the invention is an apparatus in the form of a yo-yo that functions in an improved manner relative to the prior art. This is achieved through the use of a specially-designed axle that resembles a yo-yo and has a compound-shaped groove. A central portion of the groove may feature a low-friction surface. The invention further includes an improved insert retainer that enables the yo-yo to releasably retain an insert that may have a size and shape substantially equal to that of a POG.

BACKGROUND OF THE INVENTION

In the toy field, yo-yo's are perennial sellers that are used by both children and adults. As a user's skill with the yo-yo increases, he or she is able to perform yo-yo tricks of greater and greater difficulty.

Over the years, a number of improvements have been made to the basic design of the yo-yo. These improvements focused on different functional and aesthetic components of the yo-yo and have led to the creation of yo-yos that provide improved performance and/or are more visually exciting than the original, early model yo-yos.

One example of an improved yo-yo is provided in U.S. Pat. No. 3,805,443 (issued to Donald Duncan, Jr.). The taught yo-yo has uniquely-shaped side members that enable the yo-yo to "sleep" for an extended period of time compared to the prior art. Sleeping of a yo-yo is defined as the period after the yo-yo has been thrown outwardly by a user and is spinning at the end of its tether without rewinding on the tether.

To increase the aesthetics of the yo-yo, the same patent teaches the employment of removable caps on the outwardly-facing portion of each of the yo-yo's side members. Each cap is retained via an annular groove in the associated side member.

Another example of an improved yo-yo is provided in U.S. Pat. No. 5,100,361 issued to Kuhn et al. In said patent, the yo-yo includes an axle assembly that incorporates a roller bearing. The yo-yo's tether is secured to an outer portion of the axle. When the yo-yo is sleeping, said portion is designed to remain stationary while the rest of the yo-yo spins. This alleviates the problems of frictional heating and wearing of the end of the tether that can occur in conventional yo-yos in which the yo-yo's spinning axle directly contacts a stationary end portion of the tether.

It is also known in the art that the material used for the manufacture of the yo-yo will have significant impact on the yo-yo's characteristics. The traditional wooden yo-yo has extremely favorable performance attributes. More modern plastic yo-yos are very inexpensive to manufacture and are highly durable.

In an attempt to attain some of the advantages afforded by plastic and wooden yo-yos, some plastic sided yo-yo's employ wooden axles. The axles are typically in the form of a cylindrical shaft that may be sandwiched between tapered side portions. These axles are considered by some to provide better performance than axles made of a more slippery material such as metal. However, these axles are far more fragile than those made of metal. As a result, a wooden axle is not advisable for a yo-yo that will be used by a beginner. In addition, since the orientation of the yo-yo's bell-shaped end members is normally dependent on the shape of the axle, inexact machining of a wooden axle or deformation of the axle after the yo-yo has inadvertently contacted a hard surface can lead to the end members being non-parallel. This will result in impairment of the yo-yo's performance.

While recent yo-yo technology has provided yo-yos that are improved relative to the early prior art, it is still desirable to provide a yo-yo with more favorable functional and aesthetic attributes.

SUMMARY OF THE INVENTION

The invention is an improved yo-yo in which both the axle and the design of the side members have been modified to achieve certain performance, functional and aesthetic goals. While the general exterior appearance of the yo-yo is similar to that of prior art yo-yos, the structural changes provide a user with improved control of the yo-yo. The changes also potentially increase the yo-yo's sleep time. In addition, the side members of the yo-yo are adapted to receive either one or multiple removable inserts in an improved manner. The insert-retaining structure preferably enables the yo-yo to retain at least one insert that has a shape and size substantially identical to a conventional POG (a type of bottle cap now in common use as a toy).

In the preferred embodiment, the axle includes an axle shaft or pin and an axle block that surrounds a central portion of said shaft. The shaft is engaged to both of the yo-yo's side members and functions to secure together the different portions of the yo-yo. Also in the preferred embodiment, at least one end of the shaft is threadedly engaged to a nut that is received within a complementary-shaped recess in one of the yo-yo's side members. This enables a user to disassemble the yo-yo by proper rotation of one side member relative to the other side member.

The axle block has flange-type end portions and a cylindrical center portion. A thru-bore extends through the transverse axis of the block and is designed to receive the axle shaft. When the yo-yo is assembled, the axle block is centered on the shaft and has each of its end portions received within complementary cavities in the yo-yo's side members. In the preferred embodiment, a major surface of each cavity has a textured or roughened surface so that the axle block will not spin relative to the side members once the yo-yo has been assembled.

The center portion of the axle block provides a shaped cavity or groove adapted to receive an end-located loop portion of the yo-yo's tether. The inner portion of the groove (the portion nearest the bottom of the groove) is tapered relative to the center axis of the block. The outer portion of the groove preferably has substantially parallel sidewalls that, if extended downward, would intersect the block's center axis at a right angle. The upper sidewalls may have a non-smooth surface such as provided when the block is made from a wood material. This reduces slippage in a manner similar to the star-shaped pattern of engagement ribs used in some prior art yo-yos.

The compound shape of the groove functions to center the yo-yo's tether, to exactly distance the tether from the yo-yo's side members, and to provide an ideally-shaped and exactly dimensioned area for the tether to engage the side portions of the axle block when it is desired to end the sleeping action of the yo-yo. This avoids the common problem in prior art yo-yo's where the bell-shaped side members become non-parallel and thereby adversely affect the manner in which the tether interacts with the interior of the yo-yo's body.

The bottom of the axle block's groove may feature a low-friction/non-stick surface to thereby reduce friction between itself and the tether when the yo-yo is spinning. This may be accomplished through the placement of an outer layer of a non-stick substance such as TEFLON or other slippery plastic material on the center portion of the axle block. This can also be accomplished through the use of a multi-part axle block in which the central portion is replaceable and has a low-friction surface.

In the preferred embodiment of the invention, the axle block is made from wood while the yo-yo's end members are made from plastic. This provides a yo-yo that offers all of the advantages of a plastic yo-yo (ease of manufacture, low cost and high durability) with the performance advantages provided by wooden yo-yo's (excellent control of the yo-yo's sleeping action). To avoid the problems of dimensional instability suffered by prior art wooden axles whereby the yo-yo's side members become non-parallel, the outer diameter of each of the side portions of the axle block is much greater than employed in the prior art. This greater diameter is combined with a complementary receiving surface in each side member that inherently has a much larger surface area than employed in prior art yo-yos. As a result, the side members are supported much more securely than in prior art yo-yos. To avoid the durability problems associated with prior art yo-yo's having wooden axles, the side portions of the axle block are much thicker at their base than those of prior art yo-yo's.

To increase the versatility and aesthetic appeal of the yo-yo, the yo-yo's side members may each include retaining structure adapted to secure at least one insert to the associated side member of the yo-yo. The insert may be in the form of a POG and thereby enable the yo-yo to act as a display, storage and/or carrying unit for a diverse toy. The retaining structure preferably has a flat area to enable the secure retention of the insert without causing damage to said insert. The flat area of the retaining structure facilitates manufacturing of the structure while also allowing said structure to retain inserts of slightly different diameters. A plurality of tapered ribs may be also be employed to help center the insert. Furthermore, the retaining structure may provide a partial gap about the exterior of the insert to facilitate removal of said insert from the side member. In addition, a plurality of retaining structures may be included in each side member to enable the retention of multiple inserts in one side member. The outermost insert could then function to protect the underlying insert from damage.

DETAILED DESCRIPTION OF THE DRAWINGS

Figure 1:
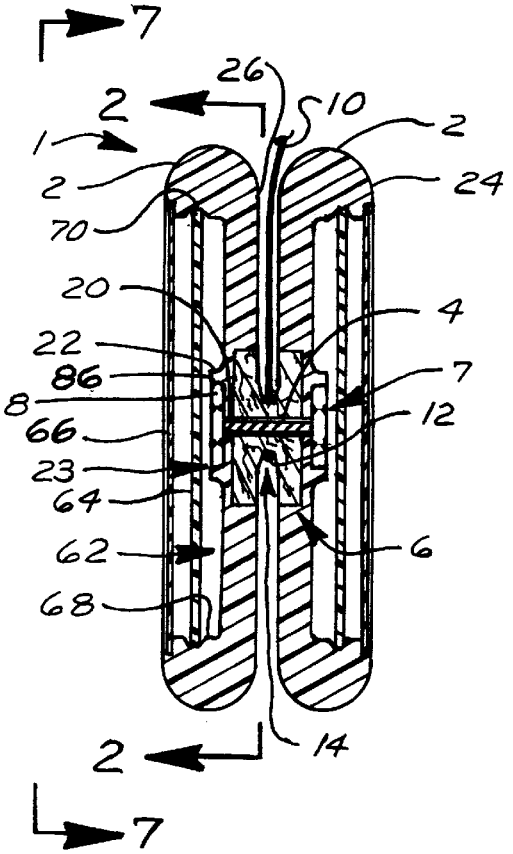
FIG. 1 is a cross-sectional, elevational view of a yo-yo in accordance with the invention.

Referring now to the drawings in greater detail, wherein like characters refer to like parts throughout the several figures, there is shown by the numeral 1 a yo-yo in accordance with the invention.

The yo-yo 1 includes first and second disk-shaped side or end members 2 that are connected together via an axle pin 4 and axle block 6. The axle pin is preferably in the form of a hex-headed bolt 7 that is engaged to a hex nut 8. Alternatively, the axle pin can be in the form of a rivet-secured shaft or other equivalent structures known in the art.

As shown in FIG. 1, a string-type tether 10 includes a loop portion 12 that encircles a center portion 14 of the axle block. A distal portion (not shown) of the tether would normally be secured to one of a user's fingers.

Each side member 2 includes a central thru-bore 20 and a hub 22. The outer portion of the hub has a hexagonally-shaped cavity 23 (note FIG. 8) designed to inwardly receive, in a snug, non-rotatable manner, either the head of the bolt 7 or the nut 8. This enables a user to disassemble the yo-yo by turning one of the end members 2 relative to the other end member 2. The threads of the bolt 7 and nut 8 may each have a slightly different pitch to create a small amount of galling that helps to prevent inadvertent loosening of the nut from the bolt.

As known in the art, each end member 2 includes an annular rim portion 24. Most of the end member's weight is concentrated in the annular portion 24 to thereby provide the yo-yo with favorable balance and spin characteristics. The side members may be made of any well-known rigid or substantially rigid material such as wood, plastic or metal. In the preferred embodiment, each side member is made of a rigid plastic material.

Figure 2:
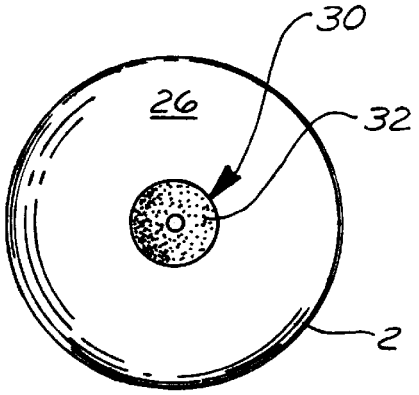
FIG. 2 is a side, elevational view of the inwardly-facing surface of one of the yo-yo's side members. The axle and axle block are not shown.

FIG. 2 shows the inwardly-facing surface 26 of one of the yo-yo's side members 2. The other side member has an identical inwardly facing surface. As shown in the figure, the surface includes a circular cavity 30. In the preferred embodiment, the bottom or major surface 32 of the cavity is preferably roughened as a result of shot-peening of the mold surface or through other conventional finishing or manufacturing methods to create a non-smooth and therefore non-slip surface.

Figure 3:
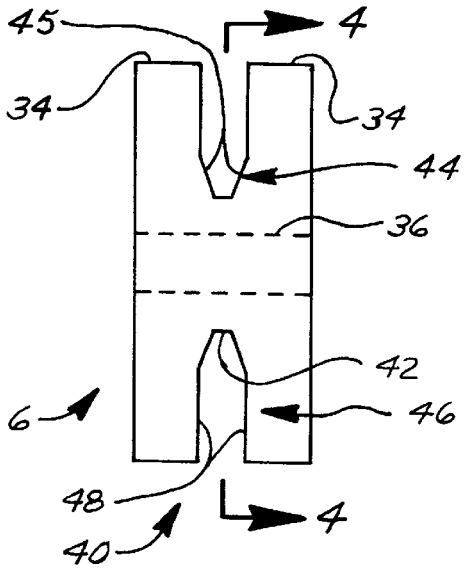
FIG. 3 is a magnified, elevational view of the axle block of the yo-yo shown in FIG. 1.
Figure 4:
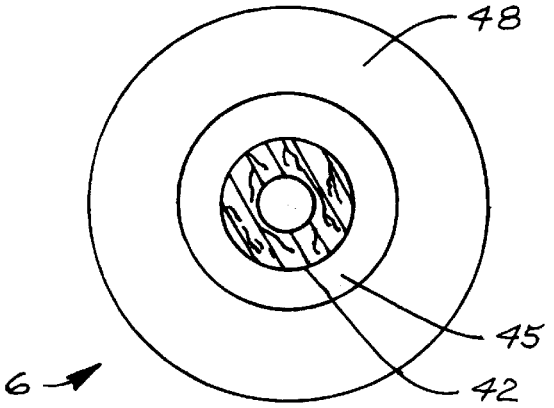
FIG. 4 is a cross-sectional end view of the axle block shown in FIG. 3.

Sandwiched between the two side members 2 is the axle block 6. FIGS. 3 and 4 provide a magnified view of the axle block. The axle block is cylindrical in shape and is preferably made of a hard material such as wood, plastic or metal. In the preferred embodiment, the axle block is made of a hard wood such as maple and has a diameter of sufficient size so that it will not break during normal use. The block has circular, flange-type end portions 34 that are complementary in shape to the cavities 30 in the side members (note FIG. 1). The contact between the end portions 34 and the non-smooth surface 32 of the cavities 30 helps to maintain the configuration of the yo-yo while preventing the side members 2 from rotating relative to each other. It should be noted that the extremely large area of the surface of the cavity 30 may itself provide sufficient friction to lock the components together even if the surface of cavity 30 is not roughened. However, the roughened surface will improve the locking engagement between the axle block and the surface of the cavities 30.

To provide dimensional stability to the yo-yo, the ratio of the diameter of each end member 2 relative to the diameter of each end portion 34 of the axle block is approximately 3:1. To achieve the strength necessary to prevent inadvertent breakage of the axle block, the ratio between the diameter of each end portion relative to their thickest part or base (where they meet the center portion of the axle block) is approximately 5:1. It should be noted that these two ratios, in combination, avoid the breakage problems associated with prior art wooden axles.

A thru-bore 36 is centrally-located in the block and forms a transverse or center axis therefore. As can be seen in the figures, the axle block itself has an overall shape that is similar to that of a yo-yo.

Located between the end portions 34 of the block and substantially perpendicular to its center axis is a central groove 40 that has a compound shape. The base 42 of the groove forms a cylindrical axle for the loop portion 12 of the tether to encircle. Extending outwardly from the base is a tapered portion 44 in which opposite sidewalls 45 extend upwards in a direction away from each other with each at approximately an 18 degree angle from the vertical (a plane perpendicular to the axle block's center axis).

Located outwardly from the lower tapered portion 44 of the groove is a groove portion 46 having sidewalls 48 that are parallel to each other and are preferably perpendicular to the axle block's center axis. It should be noted that the sidewalls 48 that form this portion are spaced apart a distance that defines the maximum width of the groove. It is in the bottom area of portion 46 of the groove that the string will expand and contact the sides of the groove when the tension on the yo-yo's tether is reduced by the user to end the yo-yo's sleeping action. The friction created when the tether contacts sidewalls 48 causes the tether to be rewound on the axle and the yo-yo to return to the user's hand. The sidewalls 48 preferably have a non-smooth surface achieved through either the basic machining that cut the surface or through a subsequent machining or finishing operation. It should be noted that while sidewalls 48 are preferably parallel to each other and perpendicular to the block's center axis, the sidewalls can be inclined. To function in the preferred manner, sidewalls 48 should be closer to being vertical than sidewalls 45. This provides a stop or shoulder for the tether to press against when the tension on the tether is reduced to end the yo-yo's sleeping action. The angle of inclination of the sidewalls 48 relative to a vertical axis perpendicular to the block's transverse axis may therefore be in the range of zero degrees to an angular measurement slightly less than the inclination of sidewalls 45.

Figure 5:
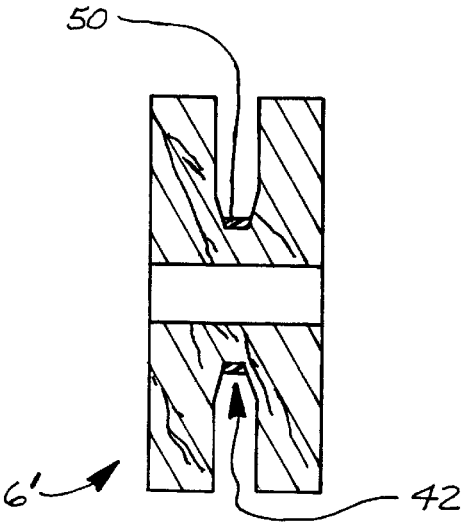
FIG. 5 is a cross-sectional, elevational view of a first alternate embodiment of an axle block for a yo-yo in accordance with the invention.

FIG. 5 shows a first alternate embodiment of an axle block 6'. In this embodiment, a layer of low-friction material 50 such as TEFLON is applied to the base 42 of the groove 40. The material 50 may be painted onto the block or be in tape form and wrapped about the center portion of the block. The low-friction material functions to reduce the friction created when the yo-yo/axle block is spinning and the loop portion 12 of the tether is stationary (when the yo-yo is "sleeping").

Figure 6:
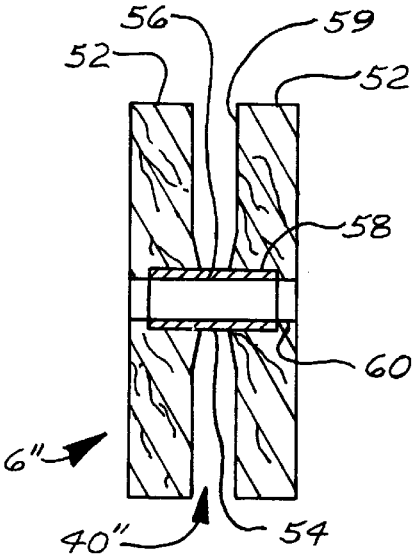
FIG. 6 is a cross-sectional, elevational view of a second alternate embodiment of an axle block for a yo-yo in accordance with the invention.

FIG. 6 shows a second embodiment of an axle block 6". In this embodiment, the block is made up of three separate pieces. First and second disk-shaped end members 52 sandwich a center rod 54. The rod includes a central thru-bore 56 through which the axle pin 4 will extend once the yo-yo has been assembled. The rod 54 is received within a shaped bore 58 located at the center of each end member 52. In addition, each member 52 has a thru bore 60 that is smaller in diameter than bore 58 and through which the axle pin 4 also passes once the yo-yo has been assembled. Alternatively but not shown, the center rod 54 can be incorporated into the structure of the axle pin in the form or en enlarged diameter portion of said pin. The end members 52 would then butt against the ends of the enlarged area. As another alternative that is not shown, the ends of the rod 54 can butt directly against the inner face of each end member 52 in lieu of being received with a shaped bore in each end member.

The end members 52 are preferably made of wood and the rod 54 is preferably made of a rigid material such as metal, wood or plastic. The rod may optionally include a TEFLON or other type of low-friction coating (not shown). The use of an uncoated metal material such as brass for rod 54 will provide high strength, wear resistance and a surface that has a low coefficient of friction. In this embodiment, a user can install different length members 52 to compensate for the use of different diameters or types of tether. In addition, a user can replace member 52 should the member become worn. It should be noted that the face 59 of each member 52 has a shape whereby once the block 6" has been assembled, it will have a central groove 40" substantially identical in shape to the groove 40 of block 6.

While two alternate embodiments of an axle block have been shown and described, it should be noted that the invention preferably allows interchangeability of the axle block portion of the yo-yo. For example, a user can remove an entire axle block and put another in its place to compensate for different diameters or types of tether 10 or to change the performance of the yo-yo.

It should also be noted that the compound shape of the axle block's groove 40 places the primary operational structure of the yo-yo within the axle block. Therefore, unlike prior art yo-yos, the side members 2 are responsible only for providing the momentum for the yo-yo's spin and do not normally make any direct contact with the tether until the tether is wound about the axle block. When the yo-yo is in its sleeping mode, only the axle block is employed to engage the tether.

By placing the primary contact area for the tether in the axle block, this allows significantly greater flexibility when positioning the end members 2. For example, there are many yo-yo tricks in which it is advantageous to reduce the possibility of the tether coming into contact with a top edge of either side member 2. Since prior art yo-yos have the tether contacting the end members even when the tether is nearly completely unwound, the spacing between the end members is thereby limited by design. As a result, the gap between prior art end members is relatively narrow. In the invention, one can employ a wider axle block to thereby increase the spacing between the end members 2 without significantly changing the operational characteristics of the yo-yo. When an extremely wide gap between the end members is desired, it may be necessary to employ an axle block in which the top end of the groove 40 includes a top area that tapers outwardly to meet the sidewalls of the end members 2. It should be noted that in this way, a yo-yo of the type shown in the drawings can have its end members located whereby their top edges are an inch or more apart. This type of spacing has previously only been possible in "BUTTERFLY" yo-yos that have specially-shaped side members.

While the preferred embodiments of the invention employ an axle block 6 that is a separate component from the axle pin 4, the axle pin and axle block can be manufactured as a single unit. In this situation, the axle pin and axle block would be the same piece and the axle block would then be defined as being a centrally-located discrete structure located between the yo-yo's end members 2.

Figure 8:
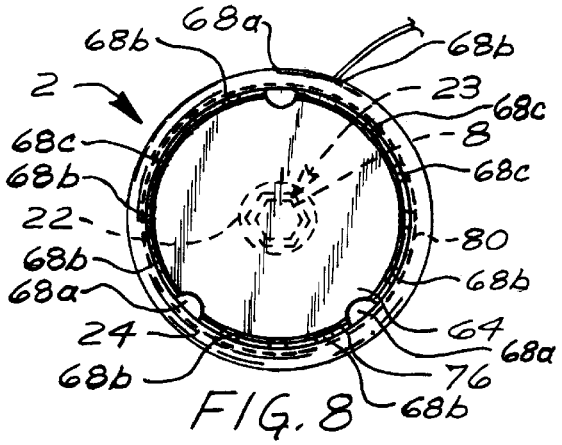
FIG. 8 is an elevational view of the end member shown in FIG. 7 after the outer insert has been removed.
Figure 7:
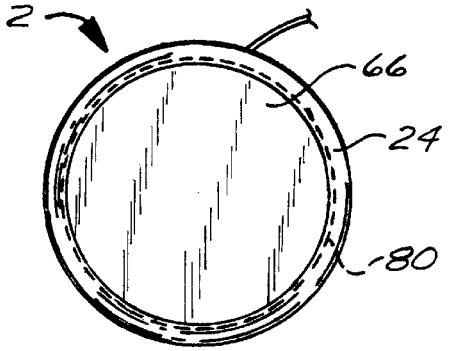
FIG. 7 is an elevational view of the exterior side surface of one of the side members of the yo-yo shown in FIG. 1.
Figure 9:
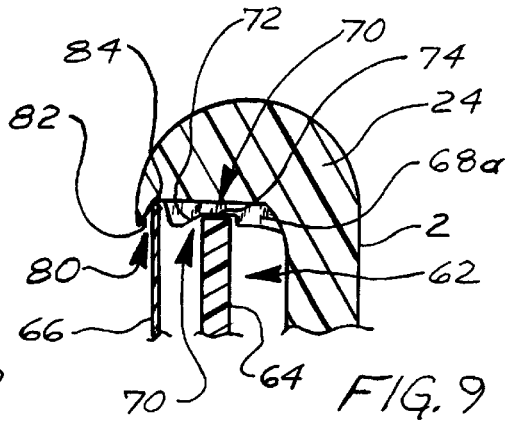
FIG. 9 is a magnified, cross-sectional view of a top portion of one of the side members of the yo-yo shown in FIG. 1.
Figure 11:
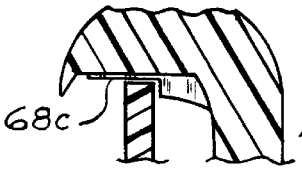
FIG. 11 is a magnified, cross-sectional view of a top portion of one of the side members of the yo-yo shown in FIG. 1. In this view, a flattened insert support rib is shown.
Figure 10:
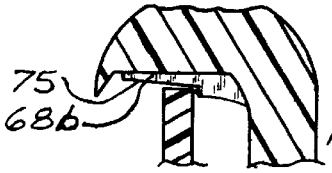
FIG. 10 is a magnified, cross-sectional view of a top portion of one of the side members of the yo-yo shown in FIG. 1. In this view, a tapered rib is shown.

FIGS. 7 and 8 provide side views of one of the end members 2 and FIGS. 9–11 provide magnified views of a top portion of the end member. As can be seen in FIG. 1, each end member includes an annular open area 62 that surrounds the hub 22. To improve the aerodynamics and aesthetics of the yo-yo, it is desirable to at least partially enclose said area. To accomplish this, an insert 64 and/or a slightly larger diameter insert 66 is secured to the interior edge of the side member's rim portion 24.

Located in an evenly-spaced manner about the periphery of area 62 are a plurality of ribs 68*a–c*. A distal end portion of each rib 68*a* includes a shaped notch 70. The notch has an angled end portion 72 and a flat inner portion 74. As shown, a planar insert 64 is placed into the area 62 until its perimeter edge passes the angled portion 72 of a plurality of the notches and is then received within the flat portion 74 of each notch. In this manner, the insert is releasably secured to the ribs. Ribs 68*b* include a tapered side edge 75 that functions to center the insert within the area 62. Ribs 68*c* are truncated and provide a stop and support for the insert. Once the insert is placed into area 62 and is engaged to ribs 68*a*, the back face of the insert contacts and rests on the front face of the ribs 68*c*.

As can be seen in FIG. 8, once the insert is secured to the end member 2, a thin gap 76 will be located about the exterior of the insert between the ribs. This gap facilitates removal of the insert whereby a user can introduce the end of a pointed tool or a fingernail into said gap and then easily pry out the insert from the ribs. In the preferred embodiment, the insert 64 is a conventional POG and has an exterior diameter of approximately 1.6 inches and a thickness of approximately 0.05 inches (an amount equal to the length of the flat portion 74 of each notch). In this manner, the yo-yo can function as a storage or carrying unit for a separate toy in the form of a POG.

As can also be seen in FIGS. 7–11, the rim portion 24 of each end member 2 also includes a shaped annular groove 80. The groove has an angled outer portion 82 and a flat inner portion 84. As shown, an insert 66 can be pressed past the groove's angled portion 82 and then into the flat portion 84 of the groove. In this manner, the insert 66 can be releasably secured to the yo-yo to fully enclose area 62. It should be noted that insert 66 is preferably slightly flexible so that one can apply pressure to an edge portion of the insert in an area between the ribs 68*a–c* to thereby cause at least a portion of the insert to pop out of the groove 80.

Figure 12:
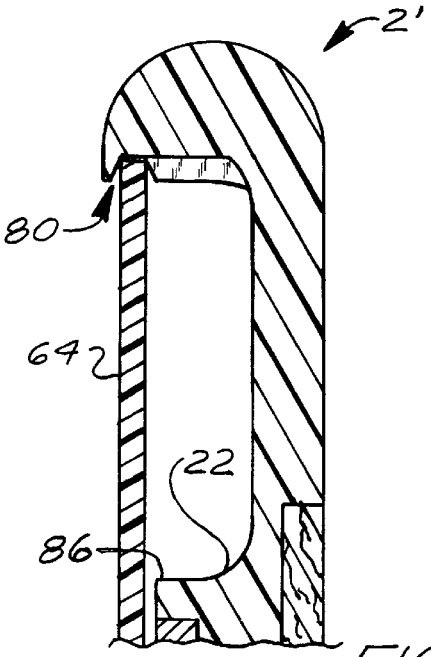
FIG. 12 is a magnified cross-sectional view of a top portion of a side member of an alternate embodiment of a yo-yo in accordance with the invention.

When a yo-yo in which a side member 2 is used to retain both of inserts 64 and 66, the outermost insert 66 will then also function to protect the inner or underlying insert 64. In some cases, the outermost insert 66 can be used to retain the inner insert to the end member. It should be noted that while a yo-yo having rib-located notches 70 and a groove 80 is shown, the yo-yo's side members can be manufactured to include only one of these retaining structures. For example, FIG. 10 shows a side member 2' that has been fabricated with only groove 80 and is therefore designed to retain only a single insert. The groove can be designed to have a slightly smaller diameter than is shown in FIG. 1 so that it can retain insert 64. In FIG. 12, the groove has a diameter whereby it is being used to retain the POG-sized insert 64. In this manner, a user's POG(s) can be prominently displayed on the extreme side surface of the yo-yo's side member.

Depending on whether either or both insert retaining structures (notches 70 or groove 80) are employed, it is desired that the distal end of the each side member's hub 22 terminate at a position whereby it's outermost end 86 is located adjacent an inner surface of a retained insert. This is shown in FIGS. 1 and 12. This enables the end of the hub to help support a center portion of said insert.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second end members;

an axle block located between said end members and having an outer diameter less than an outer diameter of each of said end members;

a securement means for securing together said end members and said axle block and wherein said axle block is engaged to said end members whereby said axle block will rotate when said end members rotate;

a tether secured to said axle block and adapted to be wound thereon; and wherein said axle block includes a groove having a compound shape, wherein said axle block has a transverse axis and wherein a vertical axis is defined as an axis perpendicular to said transverse axis, wherein an inner portion of said groove has sidewalls that are inclined at a first angle relative to the vertical axis, wherein said groove has an outer portion that has sidewalls that are non-parallel to the sidewalls of the inner portion of said groove and are oriented at an angle to the vertical axis that is less than said first angle, and wherein said inner portion of said groove functions to center said tether between said end members and wherein when the yo-yo is sleeping and a tension force on said tether is reduced to a predetermined level, the orientation and size of the sidewalls of the outer portion of said groove enables an engagement between an intermediate portion of said tether and said axle block which would cause the tether to wind about the axle block.

2. The yo-yo of claim 1 wherein the axle block is cylindrical in shape and has first and second end-located flange portions and wherein each of the yo-yo's end members includes an axially-located cavity sized to inwardly receive at least a portion of one of the axle block's flange portions.

3. The yo-yo of claim 2 wherein each of the flange portions of the axle block is disk-shaped.

4. The yo-yo of claim 2 wherein said cavity in each end member includes a surface adapted to abut an end-located surface of the axle block and wherein said surface is non-smooth to thereby help in preventing rotation of the axle block relative to the associated side member.

5. The yo-yo of claim 2 wherein each end member has an outer diameter that is about three times the outer diameter of the axle block and wherein the outer diameter of the axle block is about five times the maximum thickness of each of the axle block's flange portions.

6. The yo-yo of claim 1 wherein the sidewalls of the axle block's groove are made of a wood material.

7. The yo-yo of claim 1 wherein the axle block is constructed from three separate pieces including first and second disk-shaped members and a cylindrical center member that extends between said disk-shaped members.

8. The yo-yo of claim 1 wherein the axle block includes a center portion that has a smooth surface made of a material that has a smaller coefficient of friction than wood.

9. The yo-yo of claim 8 wherein the center portion of the axle block is made of a metal material.

10. The yo-yo of claim 8 wherein an exterior surface of the center portion of the axle block is made of a plastic material.

11. The yo-yo of claim 10 wherein the exterior surface of the center portion of the axle block has a coefficient of friction substantially equal to that of TEFLON.

12. The yo-yo of claim 1 wherein the outer portion of the groove in the axle block is substantially perpendicular to the transverse axis of the axle block.

13. The yo-yo of claim 1 wherein at least one of said end members includes a retaining means that functions to releasably retain a planar insert to an outwardly facing portion of the end member, wherein said retaining means is in the form of a notch located in an end portion of a plurality of rib members that are spaced from each other and located proximate a rim portion of the end member.

14. The yo-yo of claim 13 wherein the planar insert is a POG.

15. The yo-yo of claim 13 wherein when the insert is retained by the retaining means, a gap is located between an outer edge of the insert and an inner edge of the rim portion of the end member whereby a user can remove the insert from the end member by placing a narrow member into said gap and using said narrow member to disengage the insert from the retaining means.

16. The yo-yo of claim 13 wherein the end member adapted to retain a planar insert also includes a centering means that functions to cause the insert to be centered in the end member when said insert is acted on by the retaining means.

17. The yo-yo of claim 16 wherein the centering means is in the form of tapered side portions in the plurality of rib members.

18. The yo-yo of claim 13 wherein the retaining means includes a shaped recess having a substantially flat central portion.

19. A yo-yo comprising:

first and second disk-shaped end members;

an axle means located between said end members;

a securement means for securing together said end members and said axle means;

a tether secured to said axle means and adapted to be wound thereon; and wherein at least one of said end members has a retaining means adapted to secure a round disk to the associated end member, wherein said end member having said retaining means also includes a centering means that functions to cause the disk to be centered in the end member when said disk is acted on by the retaining means, wherein said centering means is in the form of a plurality of spaced-apart rib members having tapered side portions and located proximate a rim portion of the associated end member whereby when said disk is retained to the end member by the retaining means, a rim portion of the disk will fit against the tapered side portion of each of said rib members.

20. A yo-yo comprising:

first and second end members, wherein each of said members includes a centrally-located bore;

an axle block located between said end members and having an outer diameter less than an outer diameter of each of said end members, wherein said axle block includes a centrally-located thru-bore;

a securement means for securing and engaging said end members to each other and to said axle block whereby said axle block will rotate when said end members rotate, wherein said securement means includes an elongated member that passes through the bore of the axle block and at least partially through the centrally-located bore in each end member;

a tether secured to an exterior portion of said axle block and adapted to be wound thereon; and wherein said axle block includes a groove having a compound shape, wherein said axle block has a center axis and wherein an outer portion of said groove has sidewalls that are substantially perpendicular to said center axis and are sized whereby when the yo-yo is sleeping and a user momentarily makes the tether slack, said tether can engage at least one of said sidewalls of the outer portion of said groove to thereby cause the tether to wrap about the axle block, and wherein an inner portion of said groove has sidewalls that are non-parallel to the sidewalls of the outer portion of said groove and taper inwardly toward a bottom surface of said groove.

21. A yo-yo comprising:

first and second disk-shaped end members;

an axle block located between said end members, wherein said axle block is constructed from three separate pieces including first and second disk-shaped members and a cylindrical center member that extends between said disk-shaped members;

a securement means for securing together said end members and said axle block;

a tether secured to said axle block and adapted to be wound thereon; and wherein said axle block includes a groove having a compound shape, wherein said axle block has a transverse axis and wherein a vertical axis is defined as an axis perpendicular to said transverse axis, wherein an inner portion of said groove has sidewalls that are inclined at a first angle relative to the vertical axis, wherein said groove has an outer portion that has sidewalls that are non-parallel to the sidewalls of the inner portion of said groove and are oriented at an angle to the vertical axis that is less than said first angle, and wherein said inner portion of said groove functions to center said tether between said end members and wherein the outer portion of said groove functions to capture an intermediate portion of said tether within the sidewalls of the groove when a tension force on said tether is reduced to a predetermined level.

* * * * *